US005220950A

United States Patent [19]

Cordasco

[11] Patent Number: 5,220,950

[45] Date of Patent: Jun. 22, 1993

[54] GOLF BAG COVER

[76] Inventor: Louis M. Cordasco, 8 Wyman St., North, Rye Brook, N.Y. 10573

[21] Appl. No.: 743,168

[22] Filed: Aug. 9, 1991

[51] Int. Cl.[5] ..... A63B 55/00

[52] U.S. Cl. ..... 150/159; 206/315.4

[58] Field of Search ..... 150/159; 206/315.2-315.8; 280/DIG. 6

[56] References Cited

U.S. PATENT DOCUMENTS

| | | | |
|---|---|---|---|
| 1,899,825 | 2/1933 | Reach | 206/315.4 |
| 2,681,232 | 6/1954 | Womack | 150/159 X |
| 2,704,563 | 3/1955 | Henrich | 150/159 |
| 2,718,251 | 9/1955 | Barbato | 150/159 |
| 2,907,364 | 10/1959 | Trenery | 150/159 |
| 2,985,212 | 5/1961 | Dozier | 150/159 |
| 3,316,951 | 5/1967 | Jacobson | 206/315.4 X |
| 4,512,465 | 4/1985 | Jobe | 206/315.4 |
| 4,657,135 | 4/1987 | Kjose | 206/315.4 X |
| 4,953,768 | 9/1990 | Mose | 150/159 X |
| 5,005,623 | 4/1991 | Webster, Jr. | 150/159 |

*Primary Examiner*—Sue A. Weaver

*Attorney, Agent, or Firm*—Lackenbach Siegel Marzullo & Aronson

[57] ABSTRACT

A protective cover protects and covers a golf bag. The protective cover includes a base portion and a middle portion which is connected to the base portion, and has an opening for allowing the golf bag to be inserted into the cover with the base of the golf bag fitting into the base portion of the cover. Further, the cover includes a top portion connected to the middle portion. The top portion has a height sufficient for covering a plurality of golf clubs stored in the golf bag, and an opening is also provided in the top portion for allowing access to the golf clubs.

20 Claims, 4 Drawing Sheets

GOLF BAG COVER

FIELD OF THE INVENTION

The present invention relates generally to golf bag covers and, more particularly, to a golf bag cover which protects the entire golf bag and the golf clubs stored therein.

BACKGROUND OF THE INVENTION

Covers which enclose and protect a golf bag and golf clubs while traveling are conventionally known. Such travel covers are required to be constructed of durable and rugged material to withstand the rigors and rough handling associated with traveling. Accordingly, golf bag travel covers are made of a heavy canvas or similar material, or even impact resistant, high density molded polyurethane. Generally, such travel covers are bulky and do not allow convenient accessibility to the golf clubs contained therein.

Therefore, golf bag travel covers are not designed or constructed to be used while actually golfing so as to protect the golf bag and golf clubs from the effects of the golf course and the weather.

Attempts have been made to provide protection for golf bags and/or golf clubs while golfing. For example, U.S. Pat. No. 2,985,212 to Dozier relates to a transparent waterproof golf bag cover which provides access to the golf clubs stored therein through a slit at its upper end. However, the bottom of the Dozier cover is open so that the cover can be pulled down over the golf clubs and golf bag. Such an opening at the bottom of the cover defeats the purpose of providing protection for a golf bag while golfing, because the bottom of the golf bag will be exposed, and whenever the golfer stands his golf bag upright on the ground to play a shot, the unprotected bottom of his golf bag will be vulnerable to the ground upon which it is placed.

Moreover, disadvantageously, the opening at the bottom of the Dozier cover will allow the cover to "run up" or slide up along the length of the golf bag, leaving the golf bag at least partially uncovered and unprotected. The Dozier cover attempts to alleviate such a problem by providing a zipper at the bottom of the cover, so that when the zipper is closed, the bottom opening is reduced to provide a tighter fit. However, since the opening at the bottom of the cover is never completely closed, the bottom of the golf bag will never be completely protected and the problem of the cover sliding up along the length of the golf bag will not be solved.

U.S. Pat. No. 5,005,623 to Webster, Jr. relates to another golf bag rain cover. However, the Webster, Jr. cover only encloses the top of the golf bag and golf clubs. In other words, the middle and bottom portions of a golf bag are not protected by the Webster, Jr. cover.

Thus, there remains a need for a cover which snugly and securely encases a golf bag, allows for easy insertion of the golf bag and golf clubs into the cover, can be conveniently used while golfing, protects the entire golf bag as well as the golf clubs stored therein, and allows for easy access to golf clubs stored in the golf bag, as well as other items stored in the golf bag, such as tees, balls, shoes, raingear, sweater, a telephone, etc.

SUMMARY OF THE INVENTION

It is, therefore, a principle object of the present invention to provide an improved golf bag and golf club cover which overcomes all of the disadvantages of prior covers.

Generally, the golf bag and golf club cover of the present invention includes a base portion, a middle portion and a top portion. The middle portion is connected to the base portion and has a first middle portion opening allowing a golf bag with a neck and base to be inserted therein, whereupon the base of the golf bag fits into the base portion. The top portion is connected to the middle portion, has a height sufficient for covering golf clubs within the golf bag, and includes an opening which allows for easy access to the golf clubs. Furthermore, securing means may be provided to secure the cover to the golf bag. Accordingly, the cover of the present invention fits snugly and securely on to the golf bag, can be conveniently used while golfing, protects the entire golf bag as well as the golf clubs contained therein, and allows for easy access to the golf clubs.

Other objects, features and advantages of the present invention will become apparent with the following detailed description taken together with the accompanying drawings.

BRIEF DESCRIPTION OF THE DRAWINGS

For a fuller understanding of the invention, reference is made to the following description taken in connection with the accompanying drawings in which.

DETAILED DESCRIPTION OF THE PREFERRED EMBODIMENTS

Figure 1:
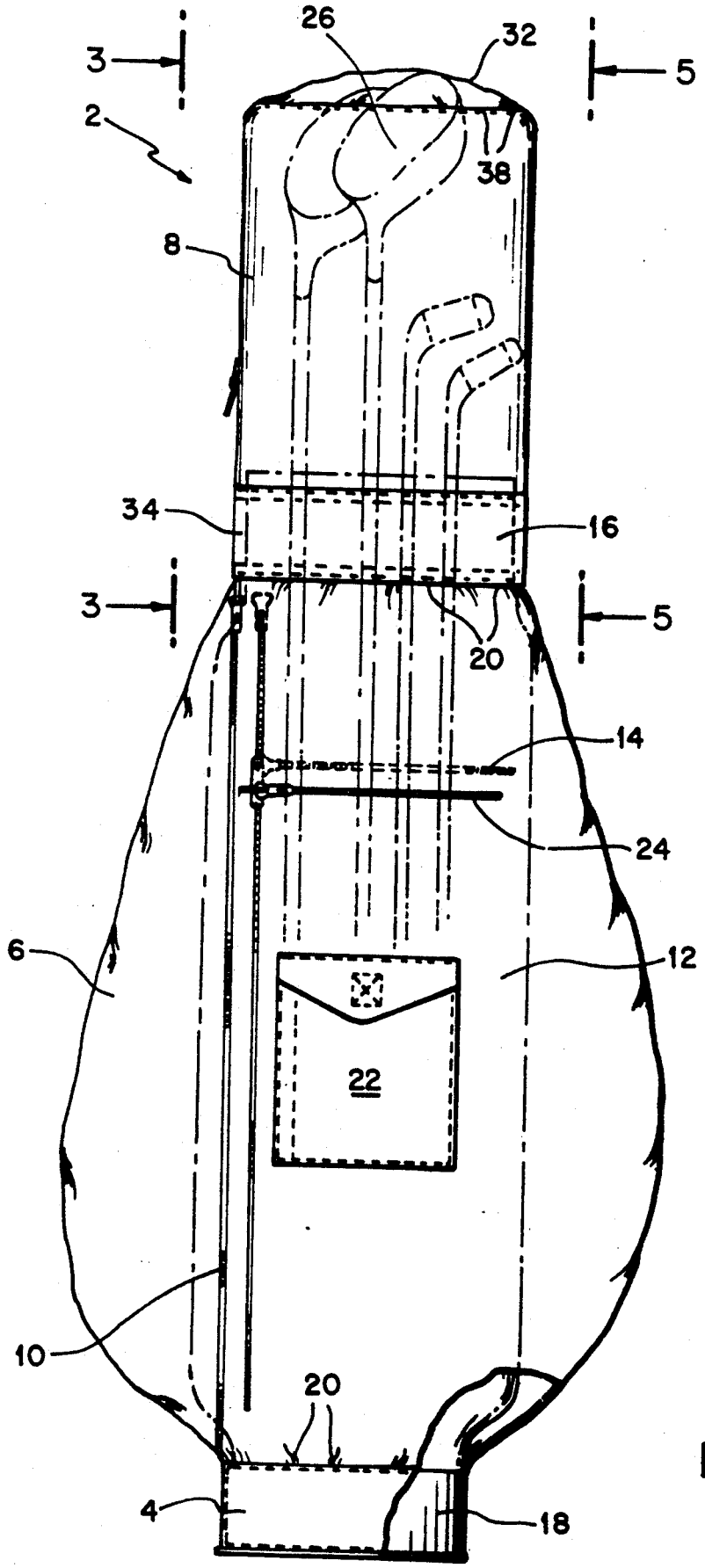
FIG. 1 is a front view of the golf bag cover according to the present invention.

Referring to the Figures, a protective cover 2 for a golf bag 12 and golf clubs 26 according to the present invention includes a plurality of portions. For example, a base portion 4, a middle portion 6, and a top portion 8. The middle portion 6 may include a first middle portion opening 10 which is positioned, for example, in the front of the middle portion 6 and illustratively extends along the full middle portion 6 for allowing a golf bag 12 to be inserted into the cover 2, and/or allowing access to a storage pocket 14 which may be provided along a side of the golf bag 12. In this connection, golf bags generally have storage sections, such as one or more means, such as storage pockets 13 and 14 for storing golf club head covers, golf balls, gloves, tees, golf shoes, a rain jacket, etc.; and such storage pockets 13 and 14 may be, for example, zippered openings which extend along the length of the golf bag or horizontally across a side of the golf bag.

In one embodiment of the cover, a zippered opening 24 may be included in the cover 2 and positioned, for example, at a suitable angle, such as a right angle relative to the first middle portion opening 10. Preferably, the zippered opening 24 is aligned so as to correspond to the location of the storage pocket 14 in the golf bag 12 so as to allow quick and easy access to the contents of the storage pocket 14.

The cover 2 is sufficiently flexible to be folded compactly and stored away in one of the storage pockets of the golf bag until the golf bag 12 and/or golf clubs 26 need to be protected, such as when a golfer encounters rain or other inclement weather while golfing.

The base portion 4 has a diameter and size which allows the base 18 of the golf bag 12 to fit substantially snugly within the base portion 4. Further, the first middle portion opening 10 may include a zipper or other suitable means to close the first middle portion opening 10 so that the golf bag 12 will be entirely encased within and protected by the cover 2.

Preferably, the middle portion 6 is oversized and somewhat "baggy" relative to the golf bag 12, and my include a plurality of gatherings or pleats 20. The oversized middle portion 6 along with the pleats 20 allow the middle portion 6 to expand when required for storing golfing supplies in, for example, the storage pockets 13, 14 along the side of the golf bag. In this regard, optionally, the middle portion 6 may include a storage pocket 22 for storing items, such as score cards.

The top portion 8 is connected to the middle portion 6 and preferably has a height sufficient for completely covering golf clubs 26 stored in the golf bag 12. The top portion 8 includes at least one opening which allows for success to the golf clubs 26 stored in the golf bag 12. For example, a first top portion opening 28 can be positioned along a side of the top portion 8 and/or a second top portion opening 30 can extend across the uppermost area 32 of the top portion 8. The second top portion opening 30 allows for access to longer golf clubs (such as woods) because such longer clubs can be removed from the uppermost area 32 of the cover 2; and allows a golfer to view his entire selection of golf clubs 26 stored in the golf bag 12, since the second top portion opening 30 allows the top portion 8 to be open across the uppermost area 32. Such first and second top portion openings 28, 30 preferably include suitable closure means, such as zippers, hook and loop fasteners, snaps, etc. As shown in the Figures, the first and second top portion openings 28, 30 may be substantial right angles or transverse relative to one another.

Moreover, suitable wrapping/locking means, such as securing band 34 is preferably provided as part of the cover 2. For example, the securing band 34 may be connected to or integral with part of the top portion 8 and positioned around the top portion or neck 16 of the golf bag 12 so that the cover 2 is secured snugly in place around the neck 16 of the golf bag 12 so as to position and maintain the cover in place about the golf bag 12, in conjunction with the base of the cover as noted herein. If desired, the ends may be fastened together or overlapped and fastened by a fastener 36 which, for example, snugly secures the band 34 around the golf bag 12. Such a fastener 36 can be, for instance, a loop and hook fastener, a snap, a button and buttonhole, etc. Thus, the cover 2 will remain in position relative to the golf bag 12.

A plurality of pleats 38 may be provided around the uppermost area 32 of the top portion 8. The pleats 38 will allow the top portion 8 to expand so as to accommodate a multitude of golf clubs.

Additionally, a slit or second middle portion opening 40 may be provided, for example, along the rear of the middle portion 6. The second middle portion opening 40 allows for the protrusion of a shoulder strap 42 and/or handle 44 of the golf bag 12 contained within the cover 2. In this connection, the strap 42 is generally attached to the top of the golf bag 12, so that it will protrude through the first top portion opening 28 above the band 34.

Figure 2:
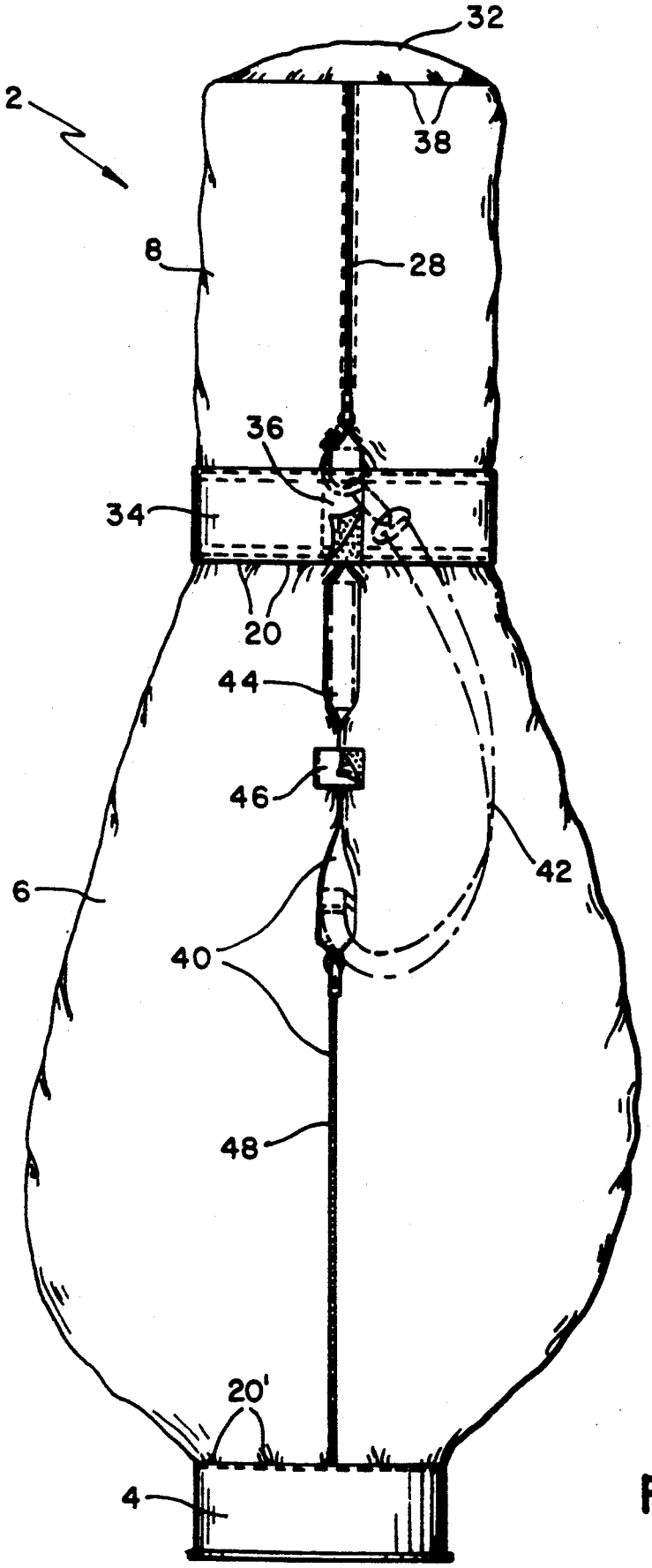
FIG. 2 is a rear view of the golf bag cover according to the present invention.
Figure 3:
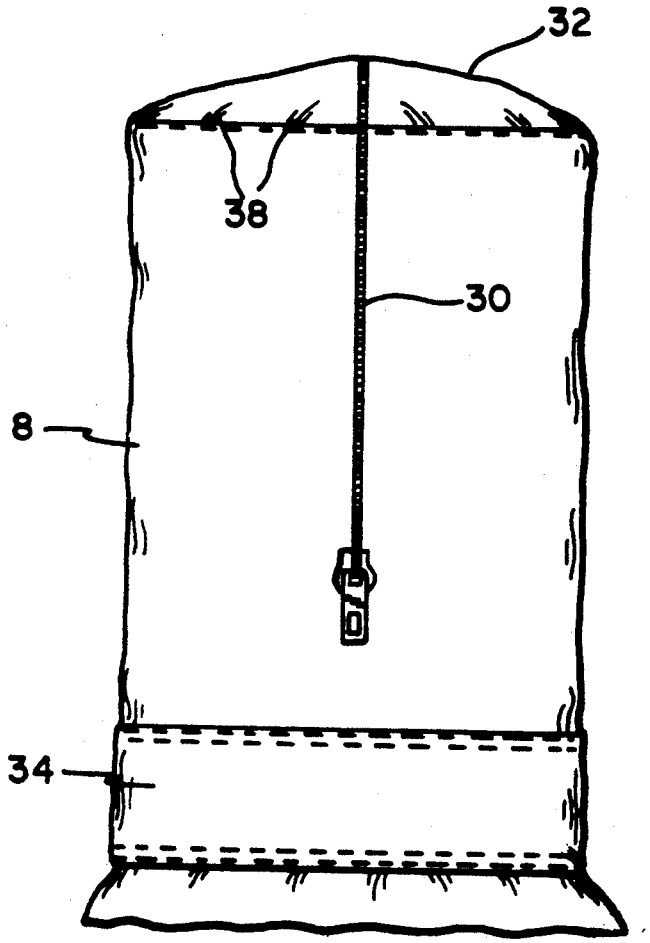
FIG. 3 is a view taken along the arrows 3—3 of FIG. 1.
Figure 4:
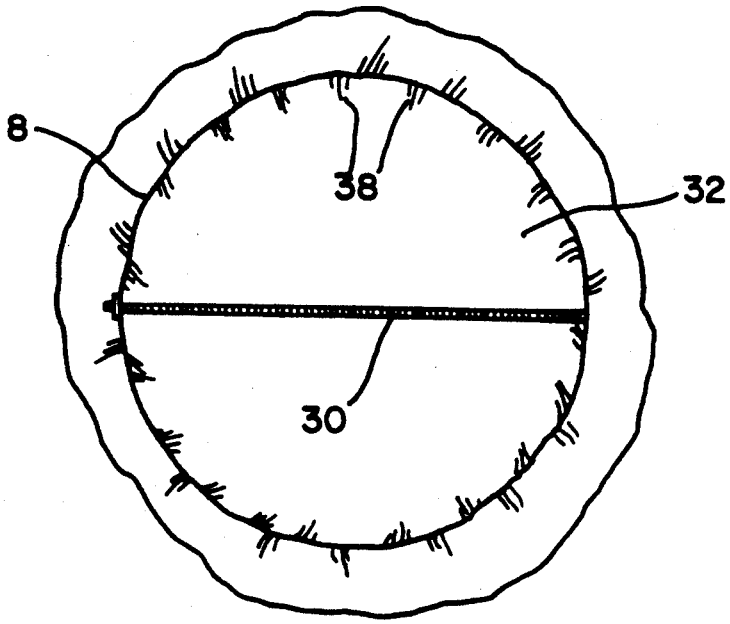
FIG. 4 is a top view of the golf bag cover according to the present invention.
Figure 5:
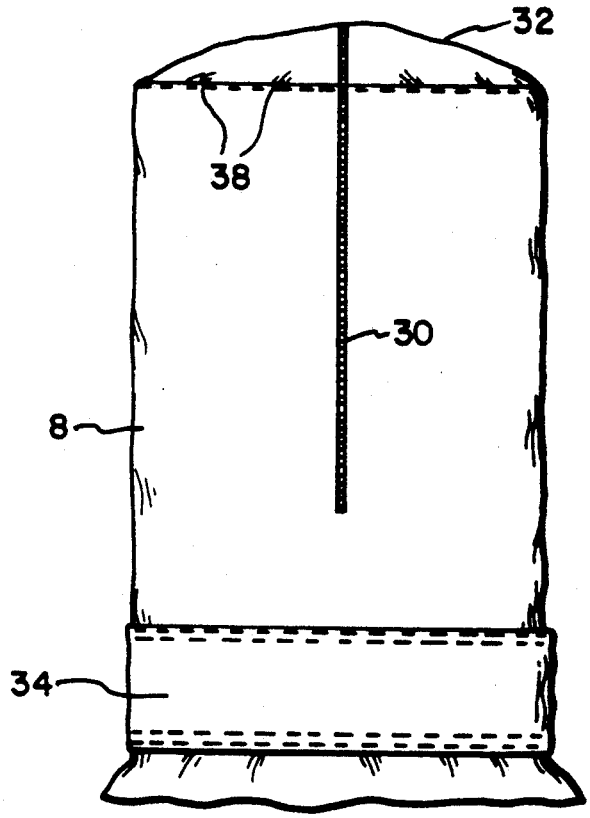
FIG. 5 is a view taken along the arrows 5—5 of FIG. 1.
Figure 6:
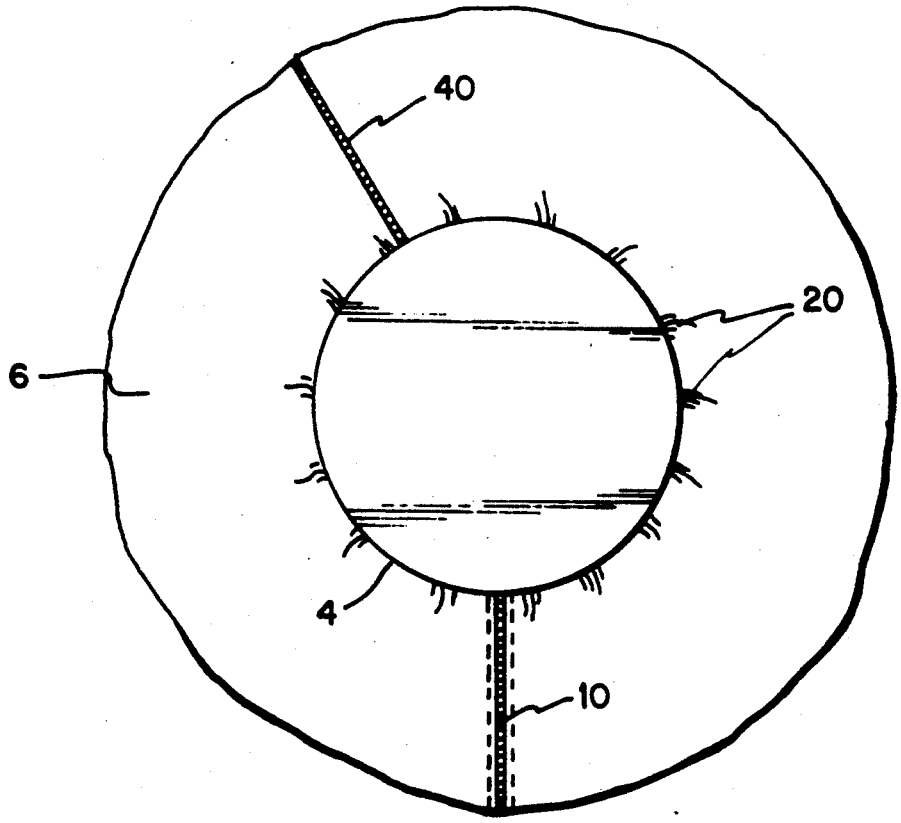
FIG. 6 is a bottom view of the golf bag cover according to the present invention.

Moreover, the second middle portion opening 40 extends along the entire length of the middle portion 6, and includes lower fastener means, such as zipper 48 and preferably one or more closure means, such as loop and hook fastener 46 for pulling together and/or closing at least a section of the second middle portion opening 40. Preferably, for simplifying insertion of the golf bag 12 and golf clubs 26 into the cover 2, the second middle portion opening 40 may be aligned with the first top portion opening 28. Thus, when both openings 28, 40 are open or unclosed, they will conjunctively in effect form and (best shown in FIG. 2) constitute a single opening extending from the base portion 4 to the uppermost area 32 of the top portion 8. It should also be understood that in the embodiment which includes the securing band 34, the opening provided between the unfastened ends of the securing band 34 can also be aligned with the first top portion opening 28 and second middle portion opening 40 to provide a single opening extending from the base portion 4 to the uppermost area 32 of the top portion 8.

Such a single opening advantageously allows the golf bag 12 having the golf clubs 26 stored therein to be inserted into the cover 2, without the need for prior removal of the golf clubs 26 from the bag 12 before inserting the golf bag 12 and the golf clubs 26 into the cover 2. Such a feature is advantageous and desirable in that the golf bag 12 and the golf clubs 26 can be quickly, conveniently and easily inserted into the cover 2. Frequently, golfers encounter inclement weather, such as rainstorms, while golfing and require immediate protection for their golf bag and golf clubs. The feature of the single opening extending from the base portion 4 to the uppermost area 32 allowing for the golf bag 12 with golf clubs 26 stored therein to be inserted into the cover 2, without removal of the golf clubs 26 from the golf bag 12, is desirable in such situations and thus most advantageous where sudden showers, hail or the like may occur.

In a further embodiment of the invention, the second middle portion opening 40 may not be aligned with the opening between the end of the band 34 or with the second top portion opening 30. Indeed, the second top portion opening 30 is also not a required feature of the invention, since the golf clubs 26 can be removed from or inserted into the bag 12 through the first top portion opening 28. In this regard, the golf bag 12 with the golf clubs 26 removed therefrom can be inserted into the cover 2 through either the first or second middle portion opening 10, 40, and the golf clubs 26 can then be inserted into the golf bag 12 through the first top portion opening 28. However, it should also be understood that the cover 2 may include only the second top portion opening 30 without the first top portion opening 28. In such an alternative embodiment, the golf bag 12 and golf clubs 26 would likewise be inserted into the cover 2 separately, i.e., the golf clubs 26 would be inserted through the first top portion opening 28 after the golf bag 12 was inserted through a middle portion opening 10 or 40.

In another embodiment, the second top portion opening 30 is excluded from the top portion 8. In such an embodiment, the cover 2 is assembled about the golf bag 12 with ten golf clubs 26 stored therein by first encasing the golf clubs 26 within the top portion 8, and pulling the middle portion 6 down along the length of the bag 12 so that the base portion 4 can be fitted about the base of the golf bag 12 while the second middle portion opening 40 is unclosed. The second middle portion opening 40 can then be closed, and the golf clubs 26 can then be accessed through the first top portion opening 28. Preferably, the entire cover 2 is made of a substantially water repellant and/or waterproof material, so that the golf bag 12 and the golf clubs 26 stored therein will be protected when golfing during reinstorms. For example, the cover 2 can be constructed of a plastic or other synthetic material, or even a natural or synthetic rubber, "Goretex", etc.; or the cover 2 can be constructed of a non-waterproof material which is rendered waterproof by a suitable coating or lining, such as by using conventional "waterproofing" substances, such as "Scotchguard", waxes, etc. However, it is preferable that the material used is strong yet adequately collapsible and flexible, i.e. "soft", so that the cover 2 can be compactly folded or rolled, for example, in a "ball" for storing, such as in a storage pocket of the golf bag 12. The cover 2 may also be of a solid color or various contrasting colors for identification and eye pleasing purposes; and, if desired, the top portion 8 can be of a substantially clear or transparent material for allowing convenient viewing of the various golf clubs through the cover 2.

While the invention is disclosed and more particularly described with the preferably embodiment, it is not intended that the invention be limited to the described embodiment. It will be obvious to those skilled in the art that modifications may be made without departing from the scope and spirit of the invention. Thus, it is intended that the appended claims cover all equivalent variations as may be subsequently contemplated.

What is claimed is:

1. A protective cover for covering an entire golf bag having a plurality of storage sections, a neck and base and being adapted to store a plurality of golf clubs, comprising:

a base portion of a diameter and size for said golf bag to fit substantially snugly therein;

a baggy middle portion connected to said base portion for accommodating all storage sections of the golf bag, and having a first middle portion zipper opening for allowing said golf bag to be inserted therein, with the base of said golf bag fitting into said base portion of said cover;

a top portion connected to said middle portion, said top portion having sides and an uppermost area, and having a height sufficient for covering said plurality of golf clubs stored in said golf bag, and further having first and second top portion openings, said first top portion opening for allowing access to said plurality of golf clubs, and said second top portion opening positioned across the uppermost area of said top portion and extending along a side of said top portion, with said first and second top portion openings being transverse relative to one another;

means forming a part of said cover disposed between said middle and top portions for securing in conjunction with said base portion said cover snugly in place around said golf bag, so as to position and maintain said cover in said place about said golf bag.

2. A protective cover according to claim 1, wherein said first top portion opening is positioned along a side of said top portion.

3. A protective cover according to claim 1, wherein said middle portion further includes a second middle portion opening for allowing protrusion of a shoulder strap and handle of said golf bag.

4. A protective cover according to claim 3, wherein said second middle portion opening includes closure means for closing said second middle portion opening.

5. A protective cover according to claim 3 wherein said second middle portion opening extends along the length of the middle portion and substantially aligns with said first top portion opening, whereby, a single opening is provided which extends from said base portion to the uppermost area of said top portion when said first top portion opening and said second middle portion openings are unclosed, so that said golf bag having said plurality of golf clubs stored therein can be inserted into said cover through the single opening, without removing said plurality of golf clubs from said golf bag.

6. A protective cover according to claim 1, wherein said middle portion further includes a storage pocket.

7. A protective cover according to claim 1, wherein said middle portion is oversized and baggy in size relative to said golf bag for accommodating said storage sections of the golf bag which allows for storage of other golf equipment, except for the golf clubs stored in said golf bag.

8. A protective cover according to claim 1, wherein said one of said top and middle portions further include a plurality of pleats.

9. A protective cover according to claim 1, wherein said cover is made of substantially waterproof material.

10. A protective cover according to claim 1, wherein said cover is made of a flexible material.

11. A protective cover according to claim 1, wherein all portions of said cover are made of the same material.

12. A protective cover according to claim 1, wherein said securing means is provided with ends forming hook and look type fasteners.

13. A protective cover for covering an entire golf bag having a plurality of storage sections, a neck and base and being adapted to store a plurality of golf clubs, comprising:

a base portion of a diameter and size for said golf bag to fit substantially snugly therein;

a baggy middle portion connected to said base portion for accommodating all storage sections of the golf bag, and having a first middle portion zipper opening for allowing said golf bag to be inserted therein, with the base of said golf bag fitting into said base portion of said cover;

a top portion connected to said middle portion, said top portion having sides and uppermost area, and having a height sufficient for covering said plurality of golf clubs stored in said golf bag, and further having a first top portion opening for allowing access to said plurality of golf clubs; and means in the form of a band having ends forming a part of said cover disposed between said middle and top portions for securing in conjunction with said base portion said cover snugly in place around said golf bag, so as to position and maintain said cover in said place about said golf bag; and wherein said band is formed between said middle and top portions and said ends are free, said band having fasteners for fastening said free ends thereof, and said baggy middle portion and said top portion being connected to each other by said band, so that said protective cover is snugly secured around said neck portion of the golf bag by said band and said fasteners.

14. A protective cover for a golf bag adapted to store a plurality of golf clubs and having a neck portion, a base and at least one storage pocket, said protective cover comprising:

a base portion being of a size for said base of the golf bag to fit substantially snugly therein;

a baggy middle portion connected to said base portion and having a middle portion opening;

a top portion formed with sides, an uppermost area and having a height sufficient for covering said plurality of golf clubs stored in the golf bag, said top portion being provided with a top portion opening;

securing means, having an intermediate opening, being disposed between said middle and top portions for securing said protective cover to said golf bag, said securing means having an intermediate opening, so that said intermediate opening forms a single uninterrupted opening with said top and middle portion openings, said uninterrupted single opening extending from said base portion to said uppermost area of the top portion to allow insertion of the golf bag and golf clubs without prior removal of the golf clubs from the golf bag; and said protective cover having at least one auxiliary opening situated to substantially align with said at least one storage pocket, so that said storage pocket is accessible through said auxiliary opening without use of said single uninterrupted opening.

15. A protective cover according to claim 14, wherein said means securing said cover around said golf bag is a band disposed about the neck of said golf bag, and having the ends which are fastened together with fastening means.

16. A protective cover according to claim 15, wherein the unfastened ends of said band form an uninterrupted single opening with said first top portion opening and said second middle portion opening extending from said base portion to the uppermost area of said top portion of said cover, whereby said single opening advantageously allows a golf bag with golf clubs to be inserted into said cover without the need for prior removal of the golf clubs from said golf bags.

17. A protective cover according to claim 14, wherein said golf bag further including additional storage pockets and said protective cover having an additional auxiliary openings aligned with said additional storage pockets, said auxiliary openings positioned at an angle to each other.

18. A protective cover according to claim 14, wherein said securing means is a band formed independently from said middle and top portions and provided with free ends, said band having fasteners for fastening said free ends thereof, and said baggy middle portion and said top portion are connected to each other by said band, so that and said protective cover is snugly secured around said neck portion of the golf bag by said band and said fasteners.

19. A protective cover according to claim 18, wherein said intermediate opening is formed by said free ends of the band when said free ends are unfastened.

20. A protective cover according to claim 14 wherein said auxiliary opening is positioned oppositely to said single uninterrupted opening.

* * * * *